US005899773A

United States Patent [19]

Cheng

[11] Patent Number: 5,899,773

[45] Date of Patent: May 4, 1999

[54] CONNECTING DEVICE WITH INTEGRALLY FORMED MALE AND FEMALE CONNECTORS

[75] Inventor: Robin Cheng, Taipei, Taiwan

[73] Assignee: Pendec Enterprise Co., Ltd., Taipei, Taiwan

[21] Appl. No.: 08/811,838

[22] Filed: Mar. 5, 1997

[30] Foreign Application Priority Data

Oct. 7, 1996 [TW] Taiwan ..... 85215389

[51] Int. Cl.[6] ..... H01R 13/00

[52] U.S. Cl. ..... 439/651; 439/680

[58] Field of Search ..... 439/651, 687, 439/696, 731, 907, 502, 875, 880, 882, 638, 680, 652, 653, 654, 655

[56] References Cited

U.S. PATENT DOCUMENTS 3,745,515 7/1973 Michaels ..... 439/651

*Primary Examiner*—Gary Paumen

*Assistant Examiner*—Tho Dac Ta

*Attorney, Agent, or Firm*—Smith, Gambrell & Russell, LLP; Beveridge, DeGrandi, Weilacher & Young Intellectual Property Group

[57] ABSTRACT

A connecting device is provided having a connector housing having a male connecting portion and a female connecting portion formed therewith a plurality of integrally formed male/female terminals mounted in the connector housing, each of the male/female terminals having a male connecting end and a female connecting end, and at least an outlet opening provided on said connector housing for branch-out wires to pass therethrough and to connect to the male/female terminals. This connecting device allows the shunt connection of at least a pair of branch-out wires from a +12V DC cable that is used to supply power to main devices to an electric fan.

15 Claims, 6 Drawing Sheets

CONNECTING DEVICE WITH INTEGRALLY FORMED MALE AND FEMALE CONNECTORS

BACKGROUND OF THE INVENTION

1. Field of the Invention

This invention relates to connectors, and more particularly, to a connecting device having integrally formed male/female connectors.

2. Description of Related Art

In personal computer (PC) systems, the CPU (central processing unit) will produce heat when operating at high speeds. So as to dissipate the heat, there are customarily provided with an electric fan and an aluminum-made plate near the CPU. Conventionally, the electric fan in a PC is connected to the power source via a connecting device as illustrated in FIGS. 1A and 1B, in which 1 designates the power source, 2*a*, 2*b*, 2*c*, 2*d* designate a set of four cables, and 3*a*, 3*b*, 3*c*, 3*d* designate four output male connectors that are respectively connected to the four cables 2*a*, 2*b*, 2*c*, 2*d*. The power source 1 converts the utility power of 110V/220V into four DC outputs that are supplied respectively via the cables 2*a*, 2*b*, 2*c*, 2*d* to the output male connectors 3*a*, 3*b*, 3*c*, 3*d* which then serve as four outlets of the power source 1. Each cable is further composed of a bundle of wires, including a yellow wire for supplying a +12V DC power, a red wire for supplying a +5V DC power, and a black wire for connecting to the ground (0V). These four outlets allow the power source 1 to supply electric power respectively to various devices in the computer, such as the mother board, the first disk drive, the second disk drive, and the fourth disk drive. Commonly, these four outlets are fully utilized. Therefore, to supply electric power to the electric fan (which needs a +12V power), a connecting device as illustrated in FIG. 1B should be used to form a shunt outlet from one of the four outlets. This connecting device includes a female connector 4, a cable 5 which includes four wires, and a male connector 7. To provide the shunt outlet for supply power to the electric fan, a pair of wires 6 are branched out from the female connector 4. In use, the female connector 4 is connected to one of the output connectors 3*a*, 3*b*, 3*c*, 3*d*, and the male connector 7 serves in substitute as the outlet to the original destination device.

One major drawback of the foregoing connecting device, however, is that the female and male connectors 4, 7 together need eight terminals to connect to the four wires in the cable 5. The connecting device of FIG. 1B is thus not only laborious to assemble, but is also costly to manufacture. Moreover, it could be occasionally connected by the user to the wrong sides.

SUMMARY OF THE INVENTION

It is therefore a primary objective of the present invention to provide a connecting device which can be made without the use of cables so that the size thereof is small.

It is another objective of the present invention to provide a connecting device which includes terminals that would be easy to manufacture.

It is still another objective of the present invention to provide a connecting device which can be made without the use of cables so that material cost can be reduced.

It is yet another objective of the present invention to provide a connecting device which can be assembled easily.

It is still yet another objective of the present invention to provide a connecting device which would not be connected to the wrong sides by the user.

In accordance with the foregoing and other objectives of the present invention, a new and improved connecting device is provided. The connecting device includes a connector housing comprising a housing body, a male connecting portion and a female portion respectively formed on two opposing ends of the housing body, a plurality of integrally formed male/female terminals made of a conductive material mounted in the connector housing, and at least a wire outlet opening formed on the connector housing for branch-out wires to be electrically connected to the male/female terminals therethrough.

Each male/female terminal comprises a rod member, and a male connecting end and a female connecting end respectively provided on two opposing ends of the rod member. The male/female terminals are mounted in the connector housing in a manner that the male connecting end of each of the male/female terminals is arranged to position in the female connecting portion so as to electrically connect to a male connector, and the female connecting end of each of the male/female terminals is arranged to position in the male connecting position so as to electrically connect to a female connector. In addition, a coupling portion can be formed on the rod member of the male/female terminal for securely joining the branch-out wire therewith by any conventional connecting means such as clamping, welding, or screwing. The branch-out wires after being securely joined with the male/female terminals thus allow the power transmitted via the terminals to be shunted to an additional device within or outside a computer.

The connector housing can be further formed by a first connector housing and a second housing adapted to be engaged with the first connector housing. The male/female terminals are thus selectively mounted in either the first connector housing or second connector housing. Similarly, the outlet opening can be provided on either the first connector housing or the second connector housing.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

Figure 2A:
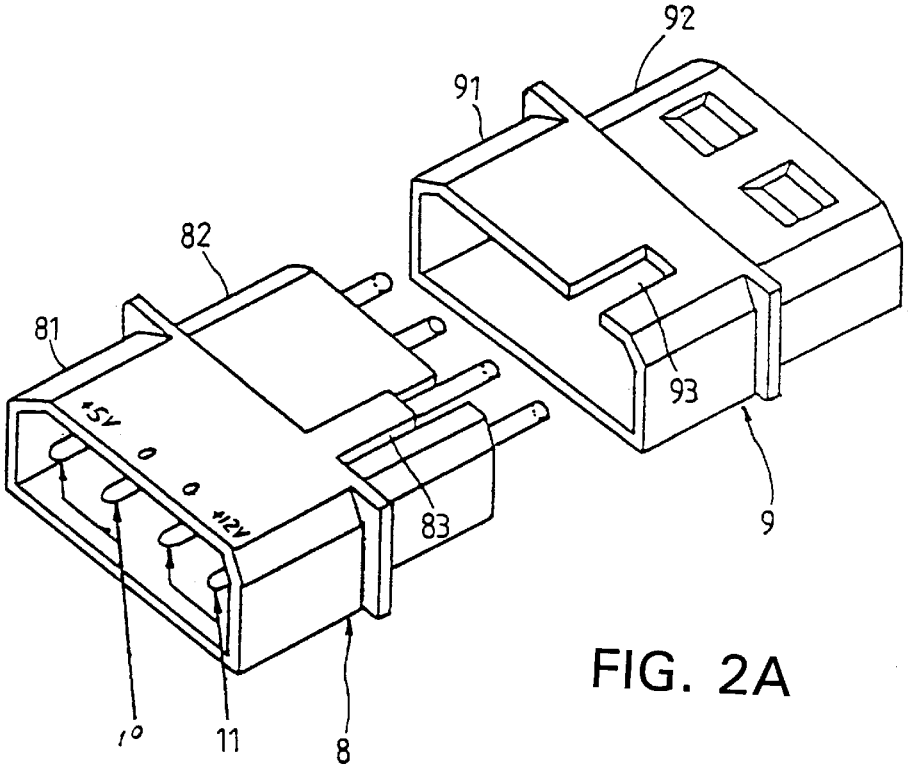
FIG. 2A is a perspective view of a first preferred embodiment of the connecting device having integrally formed male/female terminals according to the present invention, in which the first connector housing and the second connector housing are separated.
Figure 2B:
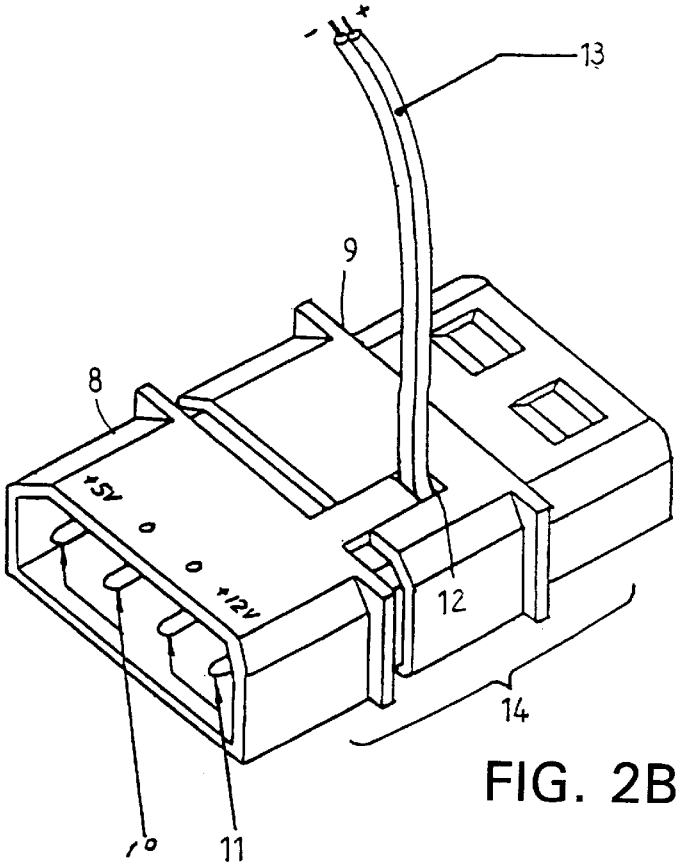
FIG. 2B is a perspective view of the connecting device of FIG. 2A when the first connector housing and the second connector housing are coupled together.

Referring to FIG. 2A, the connecting device according to the present invention is composed of a first connector housing 8, a second connector housing 9, a first pair of male/female terminals 10, and a second pair of male/female terminals 11. Both of the first and second connector housing 8, 9 are made of plastics. The first connector housing 8 comprises a first female connecting portion 81, a first male connecting portion 82 integrally formed with the first female connecting portion 81, and an insertion piece 83 laterally protruded from an edge of the first male connecting portion 82. Likewise, the second connector housing 9 comprises a second female connecting portion 91, a second male connecting portion 92 integrally formed with the second female connecting portion 91, and an insertion slit 93 formed on the second female portion 91 allowing the insertion piece 83 to be inserted thereto. Accordingly, by engaging the first male connecting portion 82 of the first connector housing 8 with the second female connecting portion 91 of the second connector housing 9, the first connector housing 8 is securely coupled with the second connector housing 9 to form a connector housing 14. As shown in FIG. 2B, the insertion piece 83 is shorter in length than the insertion slit 93 so that an outlet opening 12 is formed in the rearmost end of the insertion slit 93, allowing branch-out wires 13 to pass therethrough, when the first connector housing 8 and second connector housing 9 are coupled together.

Figure 3A:
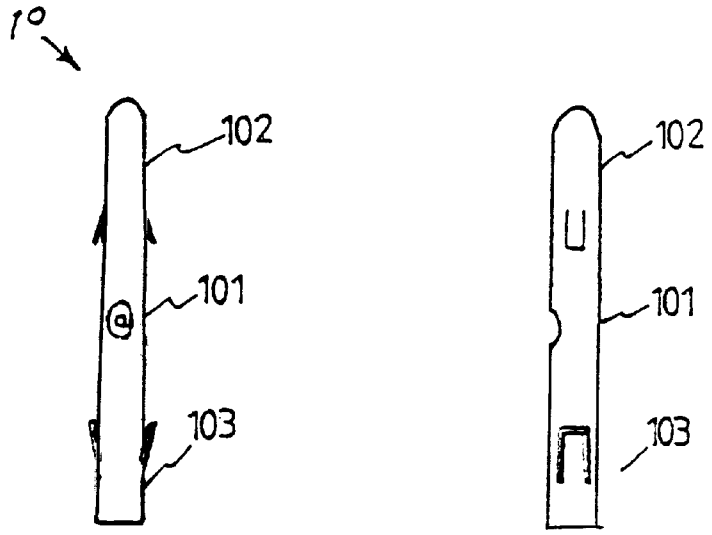
FIG. 3A shows two side views of a first preferred embodiment of a copper-made male/female terminal which is used in the connecting device of the invention as electrical contacts.
Figure 3B:
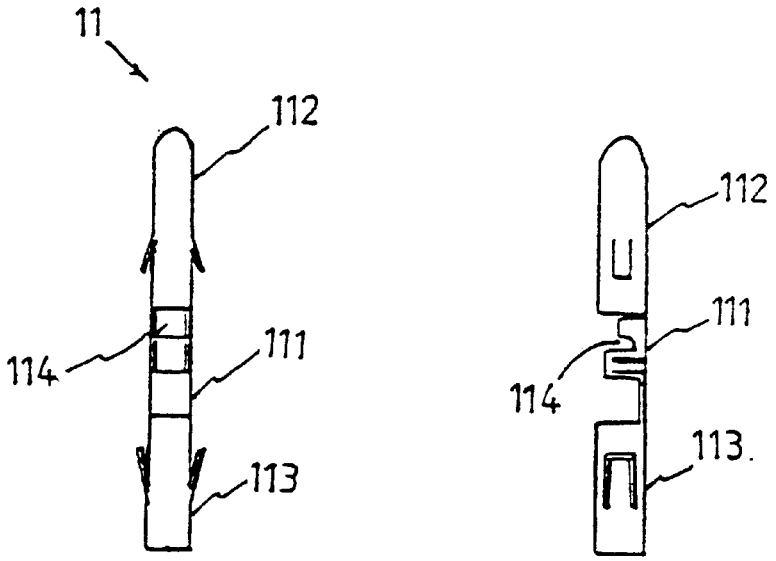
FIG. 3B shows two side views of a variation of the copper-made male/female terminal.

Referring to FIG. 3A, the male/female terminals 10 is composed of a rod member 101, and a male connecting end 102 and a female connecting end 103 respectively integrally provided on two opposing ends of the rod member 101. Referring to FIG. 3B, the male/female terminals 11 are substantially the same as the male/female terminals 10 except that a coupling portion 114 for connecting to a branch-out wire is formed on the rod member 111 of the male/female terminal 11. If no branch-out wires are to be connected, the male/female terminals 10 shown in FIG. 3A is used, which is simpler in structure that is easier to manufacture than the terminals 11 shown in FIG. 3B.

Figure 1A:
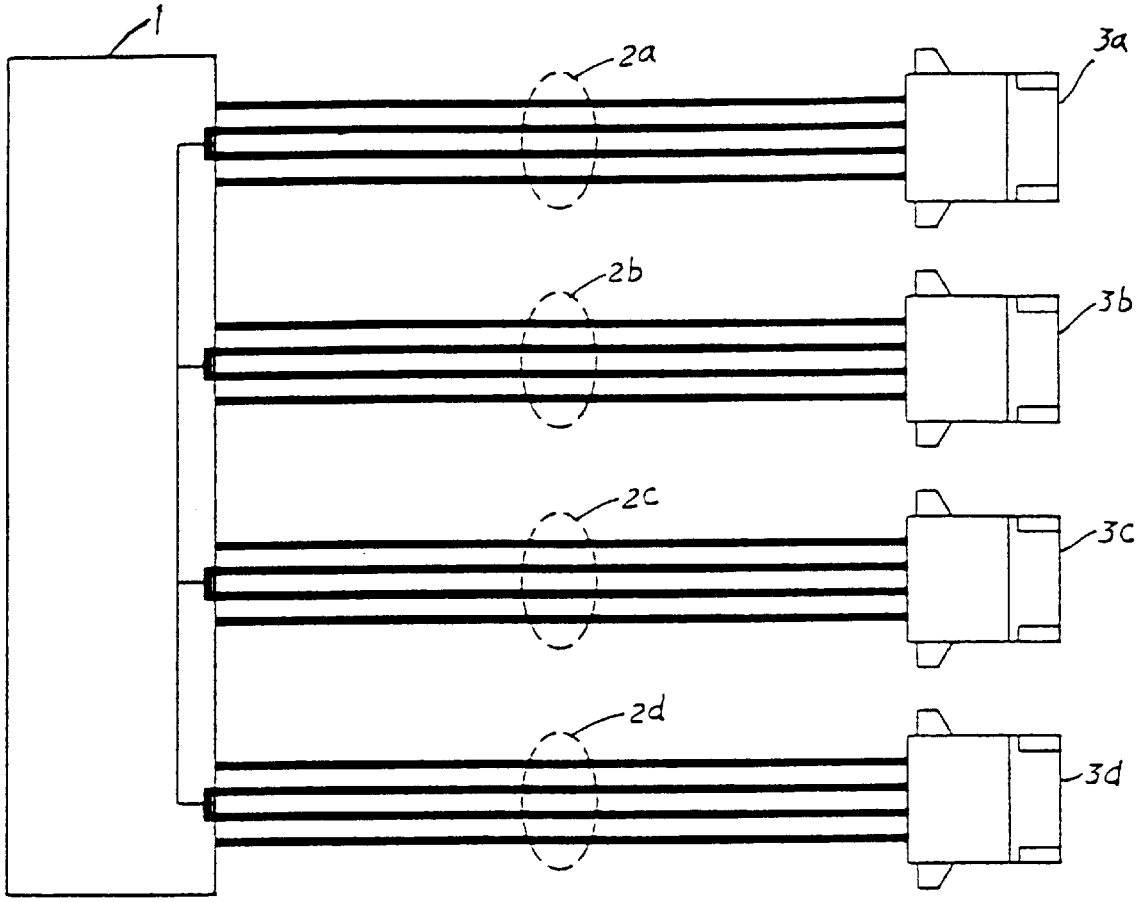
FIG. 1A (PRIOR ART)
FIG. 1A is a schematic diagram showing a computer power supply which has four DC outlets.
Figure 1B:
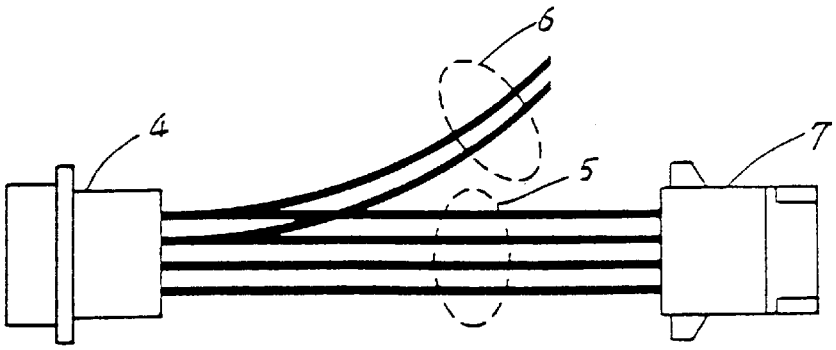
FIG. 1B (PRIOR ART)
FIG. 1B is a schematic diagram showing a conventional connecting device having a pair of cable-connected male and female connectors.

Referring to FIGS. 2A and 2B, the male/female terminals 10, 11 are mounted in positioning holes (not shown) provided in the first connector housing in a manner that the male connecting ends 102, 112 are positioned within the first female connecting portion 81 and the female connecting ends 103, 113 protrude from the first male connecting portion 82. When combining the first connector housing 8 with the second connector housing 9, the female connecting ends 103, 113 are inserted into corresponding holes in the second connector housing 9 and extended to the inside of the second male connecting portion 92. This allows the connecting device of this invention to connect to a male connector via the first female connecting portion 81 and/or to a female connector via the second male connecting portion 92. A pair of wires 13 can be connected through the outlet opening 12 to the second pair of terminals 11 so as to branch out the +12V DC power on the same to an electric fan (not shown). In use, the first connector housing 8 of the connecting device is coupled to one of the output male connectors 3*a*, 3*b*, 3*c*, 3*d* on the power source 1 shown in FIG. 1. Alternatively, the branch-out wires 13 can be two or more pairs so as to supply power to more additional devices.

Figure 4A:
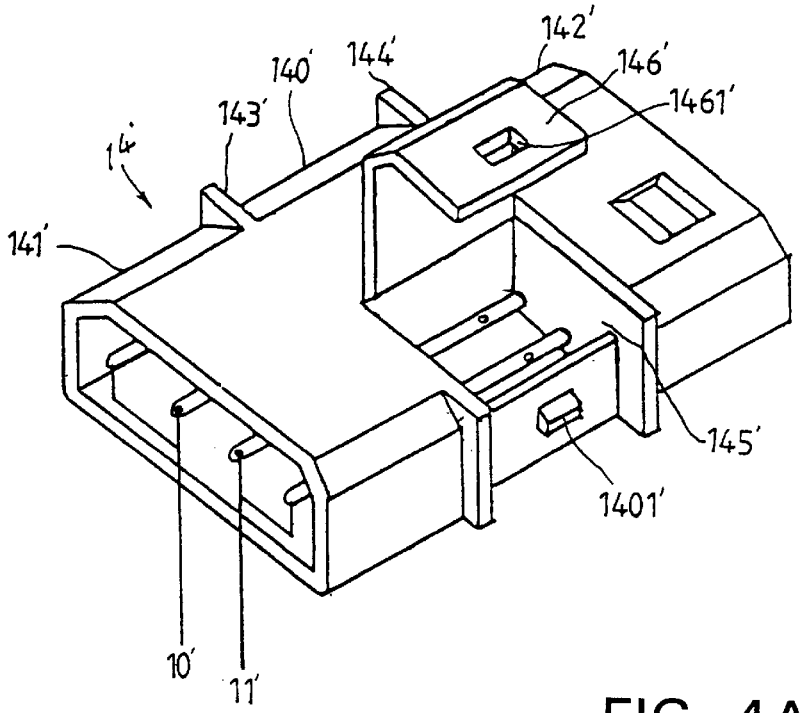
FIG. 4A is a perspective view of a second preferred embodiment of the connecting device according to the present invention.
Figure 4B:
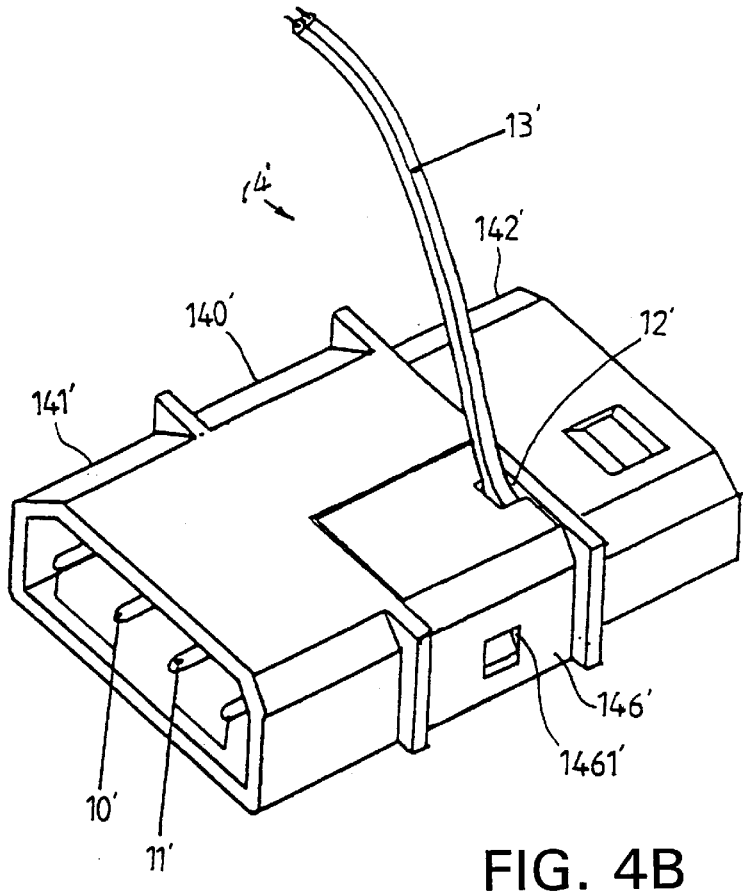
FIG. 4B is a perspective view of the connecting device of FIG. 4A which includes a pair of branch-out wires used to connect to an electric fan.

FIGS. 4A and 4B illustrate a second preferred embodiment of the connecting device according to the present invention. This connecting device of the second preferred embodiment is composed of a connector housing 14' comprising a housing body 140', a female connecting portion 141' and a male connecting portion 142' respectively integrally formed on two opposing ends 143', 144' of the housing body 140', and a first pair of male/female terminals 10' and a second pair of male/female terminals 11' mounted in the connector housing 14'. The housing body 140' has at least an opening portion 145' formed thereon and at least a cover 146' hingedly connected thereto for covering the opening portion 145', such that a certain section of the male/female terminal 11' will be exposed when the cover 146' is opened. In order to securely lock the cover 146' to the housing body 140', on one side of the housing body 140' at least a locking protrusion 1401' is provided to engage with at least a locking aperture 1461' formed on one side of the cover 146'. In addition, an outlet opening 12' is formed on the other side of the cover 146' such that a pair of branch-out wires 13' can be connected therethrough to the male/female terminals 11' in order to shunt the +12V DC power on the male/female terminals 11' to an electric fan (not shown), for example. Of course, the outlet opening 12' may also be formed in a position abutting the opening portion 145' on the housing body 140' (not shown).

Figure 5:
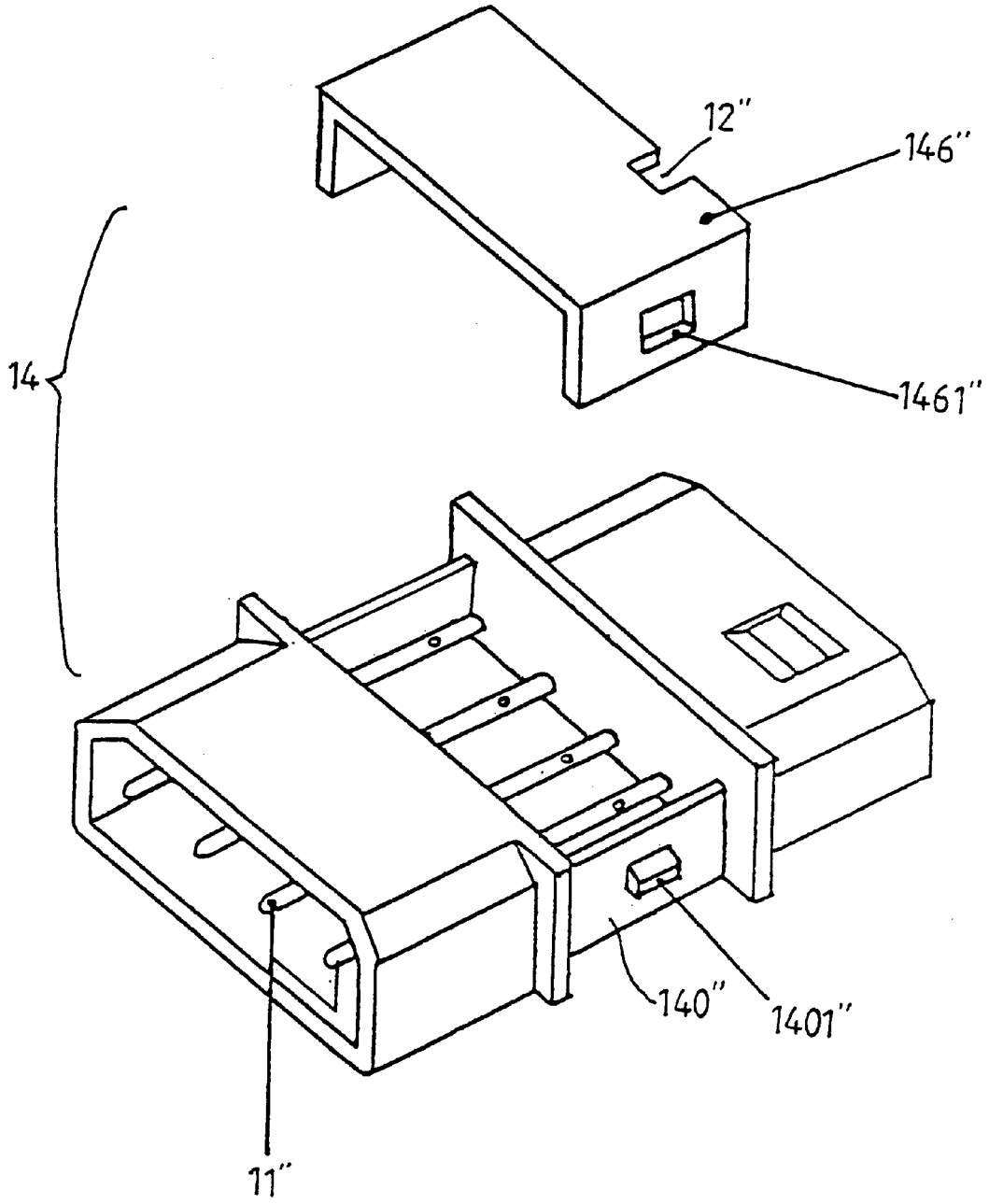
FIG. 5 is a perspective view of a third preferred embodiment of the connecting device according to the present invention.

FIG. 5 shows a third preferred embodiment of the connecting device according to the present invention. This embodiment differs from the previous one in that a removable cover 146" is provided on the connecting device 14", which can detachably removed from the housing body 140" for connecting through an outlet opening 12" formed on the removable cover 146" a pair of branch-out wires to the male/female terminals 11", thereby allowing the +12V DC power on the terminals 11" to be shunted to an electric fan (not shown). The removable cover 146" can be surely locked to the connecting device 14" by engaging at least a locking aperture 1461" on the removable cover 146" with at least a locking protrusion 1401" on each side of the housing body 140".

Figure 6A:
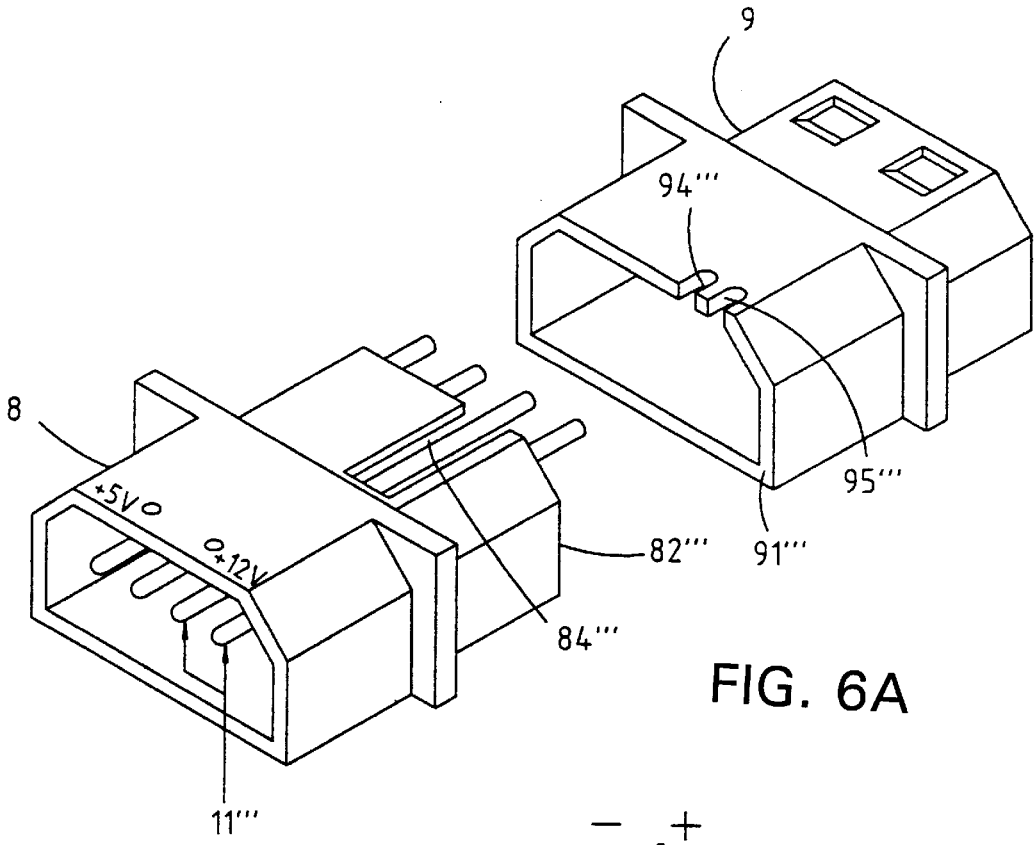
FIG. 6A is a perspective view of a fourth preferred embodiment according to the present invention, in which the first connector housing and the second connector housing are separated.
Figure 6B:
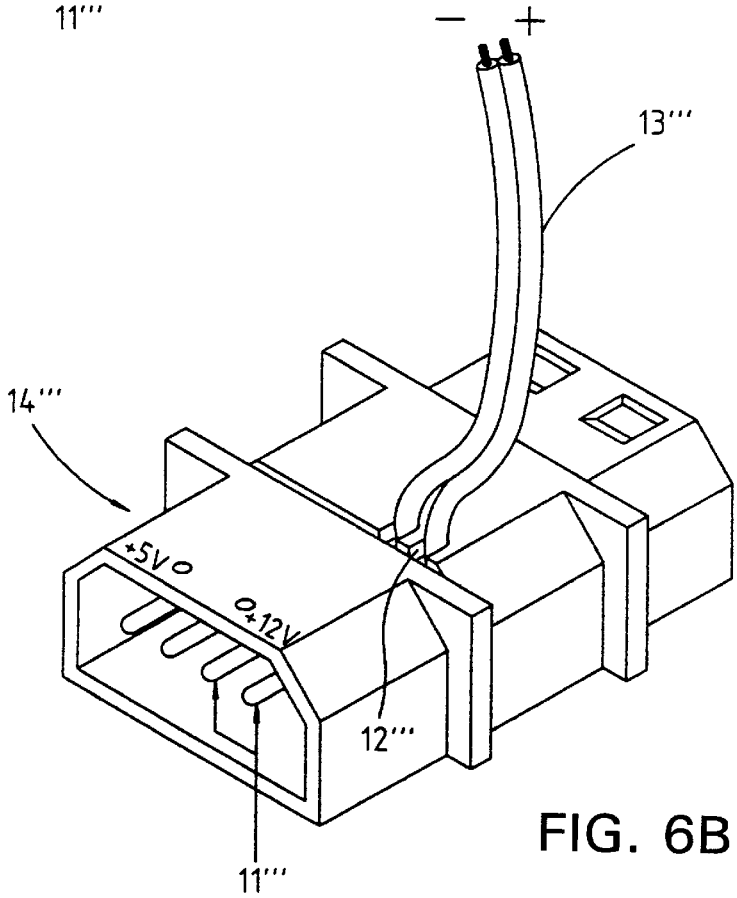
FIG. 6B is a perspective view of the connecting device of FIG. 6A when the first connector housing and the second connector housing are coupled together.

FIGS. 6A and 6B show a fourth preferred embodiment of the connecting device according to the present invention. This embodiment differs from the first preferred embodiment in that the first male connecting portion 82'" of the first connector housing 8'" is formed with a groove 84'" in place of the insertion piece 83 in the first embodiment, while the second female connecting portion 91'" is formed with two slits 94'", 95'". When coupling the first connector housing 8'" with the second connector housing 9'", the rearmost end of the groove 84'" and slits 94'", 95'" in combination form an outlet opening 12'", 12'" for a pair of branch-out wires 13'" to pass therethrough and to connect to the male/female terminals 11'".

Since the connecting device of the invention is made without the use of cables to connect between the male connecting portion and female connecting portion on both ends, the space needed in the computer casing to accommodate the connecting device is small. Manufacturing cost can also be saved. The provision of the integrally formed male/female terminals also allows the manufacture of the connecting device to be much easier, and also allow the user not to connect the connecting device to the wrong sides. These terminals also can be mounted in the connecting device very securely.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A connecting device, comprising:

a first connector housing having a first female connecting portion and a first male connecting portion;

a second connector housing having a second female connecting portion and a second male connecting portion, allowing said first connector housing to be coupled to said second connector housing by engaging one of said first male and female connecting portions with an opposite one of said second male and female connecting portions;

a plurality of integrally formed male/female terminals respectively mounted in said first and second connector housings, each of said male/female terminals having a male connecting end and a female connecting end; and an outlet opening for branch-out wires to pass therethrough and to connect to said male/female terminals, formed by providing an insertion piece on said first connector housing and an insertion slit on said second connector housing for receiving said insertion piece when said first connector housing is coupled to said second connector housing.

2. The connecting device of claim 1, wherein said outlet opening is formed by providing said insertion slit with a greater length than the insertion piece such that when said insertion piece is fully inserted in said insertion slit, a space is left in said insertion slit which serves as said outlet opening.

3. The connecting device of claim 1, wherein said insertion piece is provided on said first male connecting portion and said insertion slit is provided on said second female connecting portion.

4. The connecting device of claim 1, wherein said insertion piece is provided on said second female connecting portion and said insertion slit is provided on said first male connecting portion.

5. The connecting device of claim 1, wherein said integrally formed male/female terminals include a coupling portion which is designed for connection with a branch-out wire.

6. The connecting device of claim 1, wherein said integrally formed male/female terminals are mounted in said first connector housing in a manner that each of said male connecting ends is positioned in said first female connecting portion and said male/female terminals are arranged to extend within said first male connecting portion, and said male/female terminals are mounted in said second connector housing in a manner that said male/female terminals extend within said second female connecting portion and the female connecting ends are positioned in said second male connecting portion.

7. A connecting device, comprising:

a first connector housing having a first female connecting portion and a first male connecting portion;

a second connector housing having a second female connecting portion and a second male connecting portion, allowing said first connector housing to be coupled to said second connector housing by engaging one of said first male and female connecting portions with an opposite one of said second male and female connecting portions;

a plurality of integrally formed male/female terminals respectively mounted in said first and second connector housings, each of said male/female terminals having a male connecting end and a female connecting end; and an outlet opening for at least one branch-out wire to pass therethrough and to connect to said male/female terminals, said outlet opening being formed by providing an insertion piece on said first connector housing and an insertion slit on said second connector housing for aligning with said insertion piece when said first connector housing is coupled to said second connector housing.

8. The connecting device of claim 7 wherein said insertion piece is received within said insertion slit when said first connector housing is coupled to said second connector housing.

9. The connecting device of claim 7 wherein said insertion piece is defined by a wall section of a wall of said first connector housing which wall section is formed between a pair of spaced apart slots extending in said wall of said first connector housing, with the insertion piece being positioned in alignment and in an above/below relationship with the insertion slit formed in said second housing connector so as to allow for a first branch-out wire to extend through a first of said spaced apart slots and a second branch-out wire to extend through a second of said spaced apart slots.

10. The connecting device of claim 7 wherein said male/female terminals are elongated members each having an interior recess defined by a surrounding terminal wall which extends in a direction of elongation of said terminals, and said coupling portion of said male/female terminals is positioned within the interior recess of a plurality of said male/female terminals.

11. The connecting device of claim 7 wherein said male/female terminals include a first type of male/female terminal having a coupling portion adapted to hold a branch-out wire and a second type of male/female terminal free of said coupling portion.

12. The connecting device of claim 7, wherein said male/female terminals are mounted in said first connector housing in a manner that said male connecting end of each is positioned in said first female connecting portion and said male/female terminals are arranged to extend within said first male connecting portion, and said male/female terminals are mounted in said second connector housing in a manner that said male/female terminals extend within said second female connecting portion and the female connecting ends are positioned in said second male connecting portion.

13. The connecting device of claim 7 wherein said second female connecting portion has an outer wall defining a reception cavity for receiving said first male connecting portion within the cavity upon a coupling of said first and second connector housings, said outer wall having a free edge that extends around the first male connecting portion when said connector housings are coupled, and said male/female terminals extend to opposite sides of said free edge upon a coupling of said connector housings and said outlet opening is also positioned above and at an intermediate location between said ends of said male/female terminals upon a coupling of said connector housings.

14. The connecting device of claim 13 wherein said insertion slit is formed in said outer wall and extends from said free edge further into said outer wall.

15. A connecting device, comprising:

a first connector housing having a first female connecting portion and a first male connecting portion;

a second connector housing having a second female connecting portion and a second male connecting portion, allowing said first connector housing to be coupled to said second connector housing by engaging one of said first male and female connecting portions with an opposite one of said second male and female connecting portions;

a plurality of integrally formed male/female terminals respectively mounted in said first and second connector housings, each of said male/female terminals having a male connecting end and a female connecting end, and each of said male/female terminals extending to opposite sides of a coupling interface between said first and second connector housings upon a coupling of said first and second connector housings, and included amongst said male/female terminals is a branch wire connecting male/female terminal type that includes a branch wire coupling section formed therein, with said branch wire coupling section being aligned with a branch wire outlet opening formed at said coupling interface by said first and second connector housings upon a coupling of said connector housings such that a branch wire is allowed to pass through said branch wire outlet opening and to connect to said branch wire connecting male/female terminal type of said male/female terminals.

* * * * *